US009650985B2

(12) United States Patent
Toda et al.

(10) Patent No.: US 9,650,985 B2
(45) Date of Patent: May 16, 2017

(54) FUEL INJECTION CONTROL APPARATUS OF ENGINE

(71) Applicant: Mitsubishi Jidosha Kogyo Kabushiki Kaisha, Tokyo (JP)

(72) Inventors: Hitoshi Toda, Okazaki (JP); Toshiyuki Miyata, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 104 days.

(21) Appl. No.: 14/558,914

(22) Filed: Dec. 3, 2014

(65) Prior Publication Data

US 2015/0167580 A1 Jun. 18, 2015

(30) Foreign Application Priority Data

Dec. 13, 2013 (JP) ..... 2013-258636

(51) Int. Cl.

| | |
|---|---|
| ***F02D 41/38*** | (2006.01) |
| ***F02D 41/24*** | (2006.01) |
| ***F02D 41/30*** | (2006.01) |
| ***F02D 41/14*** | (2006.01) |

(52) U.S. Cl.

CPC ..... *F02D 41/38* (2013.01); *F02D 41/1402* (2013.01); *F02D 41/1444* (2013.01); *F02D 41/248* (2013.01); *F02D 41/2454* (2013.01); *F02D 41/2467* (2013.01); *F02D 41/3094* (2013.01); *F02D 2041/389* (2013.01)

(58) Field of Classification Search

CPC .. F02D 41/38; F02D 2041/389; F02D 41/144; F02D 41/1454; F02D 41/2454; F02D 41/2467

See application file for complete search history.

(56) References Cited

U.S. PATENT DOCUMENTS

2006/0207559 A1* 9/2006 Kinose ..... F02D 41/2445 123/431

FOREIGN PATENT DOCUMENTS

JP 4752636 B2 8/2011

* cited by examiner

*Primary Examiner* — Jacob Amick

(74) *Attorney, Agent, or Firm* — Birch, Stewart, Kolasch & Birch, LLP

(57) ABSTRACT

A fuel injection control apparatus of an engine, which can inhibit a learning time from lengthening, is provided. With the fuel injection control apparatus, learning control over one of a first fuel injection valve and a second fuel injection valve is exercised in an operating region of the engine where fuel is injected from each of the first fuel injection valve and the second fuel injection valve, and the change rate of a learning value by the learning control is altered in accordance with an injection ratio between the first fuel injection valve and the second fuel injection valve.

3 Claims, 6 Drawing Sheets

FUEL INJECTION CONTROL APPARATUS OF ENGINE

The entire disclosure of Japanese Patent Application No. 2013-258636 filed on Dec. 13, 2013 is expressly incorporated by reference herein.

TECHNICAL FIELD

This invention relates to a fuel injection control apparatus of an engine, which is equipped with a plurality of fuel injection valves corresponding to respective cylinders and controls, as appropriate, the injection volumes of the respective fuel injection valves.

BACKGROUND ART

With an engine loaded on a vehicle or the like, a fuel injection volume has so far been set in accordance with the amount of intake air so that an air-fuel ratio will become a preset target air-fuel ratio. Owing to, for example, changes in the operating state of the engine or variations in the characteristics of fuel injection valves, however, the desired volume of fuel may fail to be injected. Usually, therefore, feedback control over the fuel injection volume is exercised, as appropriate, based on exhaust air-fuel ratio information from an air-fuel ratio sensor (for example, a linear air-fuel ratio sensor (LAFS) or an $O_2$ sensor) provided in an exhaust passage. With this feedback control, a feedback correction factor is set based on the exhaust air-fuel ratio information, and the fuel injection volume is corrected, as appropriate, in accordance with the feedback correction factor.

Moreover, the amount of deviation in the injection volume due to a specific variation of the fuel injection valve can also be corrected by feedback control. Separately, however, learning control for learning the deviation amount is performed to set a learning value, and correction of the deviation amount is made based on the learning value. It is preferred, for example, to perform the learning control at the time of replacing the fuel injection valve, and complete it in as short a time as possible. This is intended to suppress the deterioration of an exhaust gas due to the deviation of the injection volume.

In an engine having a first fuel injection valve (port injection valve) for injecting fuel into an intake passage (intake port) and a second fuel injection valve (cylinder injection valve) for injecting fuel into a combustion chamber, fuel injection volumes need to be corrected, as appropriate, for the first fuel injection valve and the second fuel injection valve, respectively. An example of the engine is designed to calculate the correction amount of each fuel injection valve in accordance with the injection sharing ratio between the port injection valve and the cylinder injection valve (see, for example, Patent Document 1).

PRIOR ART DOCUMENTS

Patent Documents

[Patent Document 1] Japanese Patent No. 4752636

SUMMARY OF THE INVENTION

Problems to be Solved by the Invention

In the engine having the first fuel injection valve and the second fuel injection valve, not only the above-mentioned fuel injection volume, but the amount of deviation in the fuel injection volume also needs to be learned for the first fuel injection valve and the second fuel injection valve, respectively. If learning control is to be performed for the first fuel injection valve and the second fuel injection valve, respectively, it has been customary practice to set the change rate of the learning value always at a nearly constant level. This is because such a practice enables learning control to be effected, with fluctuations in the air-fuel ratio being suppressed.

If learning control over one of the fuel injection valves is to be performed in an operating region where fuel is injected from each of the first fuel injection valve and the second fuel injection valve, however, the following problem is posed: Provided that the change rate of the learning value is constant, as the fuel injection ratio of that fuel injection valve to the other fuel injection valve decreases, learning time also lengthens. In connection with this problem, when learning is in an incomplete state, the fuel quantity necessary in a transitional period and the actually injected fuel quantity do not agree, thus deteriorating an exhaust gas. Thus, the learning time should desirably be as short as possible.

The present invention has been accomplished in the light of the above-described circumstances. It is an object of this invention to provide a fuel injection control apparatus of an engine which can inhibit a learning time from lengthening.

Means for Solving the Problems

An aspect of the present invention for solving the above problems is a fuel injection control apparatus of an engine, comprising: a first fuel injection valve for injecting fuel into an intake passage of the engine; a second fuel injection valve for injecting fuel into a combustion chamber of the engine; fuel injection control device for controlling fuel injection volumes injected from the first fuel injection valve and the second fuel injection valve in accordance with the operating state of the engine; an air-fuel ratio detection device for detecting the exhaust air-fuel ratio of the engine; a feedback correction value setting device for setting a feedback correction value by feedback control based on the detection results of the air-fuel ratio detection device; and a learning control device which exercises learning control for learning the deviation amounts of the injection volumes of the first fuel injection valve and the second fuel injection valve based on the feedback correction value to set a learning value, wherein the fuel injection control device controls the fuel injection volumes of the first fuel injection valve and the second fuel injection valve, based on the feedback correction value and the learning value, such that the exhaust air-fuel ratio becomes a target air-fuel ratio, and the learning control device exercises the learning control over one of the first fuel injection valve and the second fuel injection valve in an operating region of the engine where the fuel is injected from each of the first fuel injection valve and the second fuel injection valve, and alters the change rate of the learning value by the learning control in accordance with the injection ratio between the first fuel injection valve and the second fuel injection valve.

Concretely, the fuel injection control apparatus of an engine is characterized in that the learning control device renders the change rate of the learning value greater as the injection ratio of the one fuel injection valve to the other fuel injection valve becomes lower.

With the present invention described above, the change rate of the learning value is altered in response to the injection ratio between the first fuel injection valve and the second fuel injection valve, whereby the change rate of the feedback correction factor during learning control is rendered nearly constant. That is, the change rate of the learning value is altered, as appropriate, so that the change rate of the feedback correction factor during learning control becomes nearly constant. Hence, the prolongation of learning control can be suppressed, with fluctuations in the air-fuel ratio being inhibited.

Preferably, before exercising the learning control over the one fuel injection valve, the learning control device effects the learning control over the other fuel injection valve in an operating region where there is no fuel injection from the one fuel injection valve.

Thus, even in an operating region of the engine where the fuel is injected from each of the first fuel injection valve and the second fuel injection valve, it is possible to perform learning control satisfactorily over one of the first fuel injection valve and the second fuel injection valve.

Effects of the Invention

According to the fuel injection control apparatus of an engine concerned with the present invention, as described above, prolongation of the learning time can be suppressed, with fluctuations in the air-fuel ratio being inhibited, regardless of the injection ratio between the first fuel injection valve and the second fuel injection valve. Thus, deterioration of the exhaust gas associated with learning control can be suppressed.

MODE FOR CARRYING OUT THE INVENTION

An embodiment of the present invention will be described in detail with reference to the accompanying drawings.

First of all, an explanation will be offered for an example of the entire configuration of an engine 10 according to the embodiment of the present invention.

Figure 1:
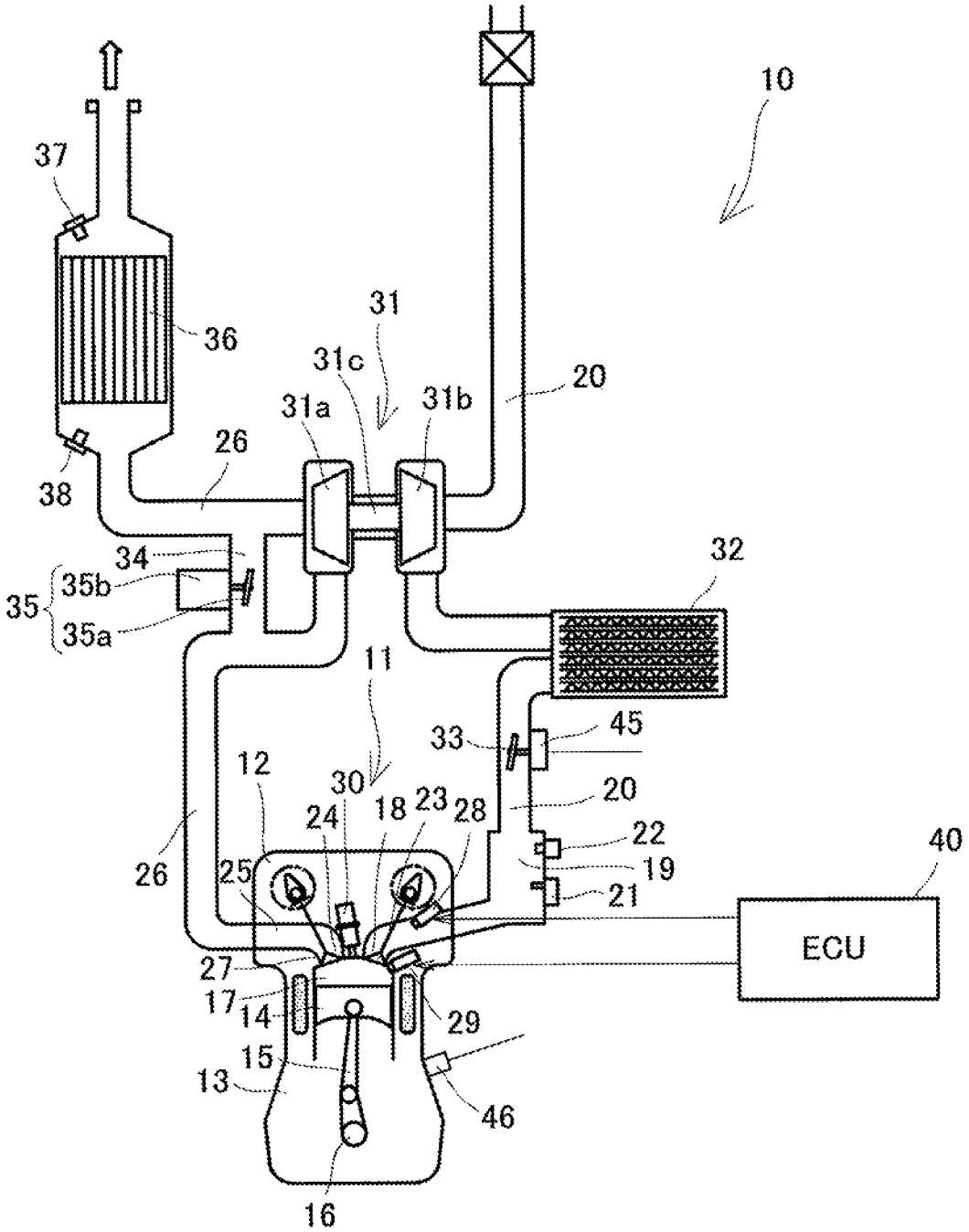
FIG. 1 is a schematic view of an engine according to an embodiment of the present invention.

As shown in FIG. 1, an engine body 11 constituting the engine 10 has a cylinder head 12 and a cylinder block 13, and a piston 14 is housed within the cylinder block 13. The piston 14 is connected to a crankshaft 16 via a connecting rod 15. The piston 14, the cylinder head 12 and the cylinder block 13 form a combustion chamber 17.

An intake port 18 is formed in the cylinder head 12, and an intake pipe (intake passage) 20 including an intake manifold 19 is connected to the intake port 18. The intake manifold 19 is provided with an intake pressure sensor (MAP sensor) 21 for detecting an intake pressure and an intake temperature sensor 22 for detecting the temperature of intake air. Within the intake port 18, an intake valve 23 is provided to open and close the intake port 18 by the intake valve 23. An exhaust port 24 is formed in the cylinder head 12, and an exhaust pipe (exhaust passage) 26 including an exhaust manifold 25 is connected to the inside of the exhaust port 24. An exhaust valve 27 is provided in the exhaust port 24, so that the exhaust port 24 is opened and closed by the exhaust valve 27, as is the intake port 18.

The engine body 11, moreover, is provided with a first fuel injection valve (intake passage injection valve) 28 for injecting fuel into the intake pipe (intake passage) 20, for example, in the vicinity of the intake port 18, and is also provided with a second fuel injection valve (cylinder injection valve) 29 for injecting fuel directly into the combustion chamber 17 of each cylinder. The first fuel injection valve 28 is supplied with fuel from a low pressure supply pump, which is installed within a fuel tank (not shown), via a low pressure delivery pipe, although this is not illustrated. The second fuel injection valve 29 is supplied with fuel from a high pressure supply pump, which further pressurizes the fuel supplied from the low pressure supply pump, via a high pressure delivery pipe. The high pressure delivery pipe is supplied with the fuel, which has been supplied from the low pressure supply pump, in a state pressurized to a predetermined pressure by the high pressure supply pump. Furthermore, the cylinder head 12 has an ignition plug 30 mounted thereon for each cylinder.

A turbocharger (supercharger) 31 is provided midway through the intake pipe 20 and the exhaust pipe 26. The turbocharger 31 has a turbine 31*a* and a compressor 31*b*, and the turbine 31*a* and the compressor 31*b* are coupled together by a turbine shaft 31*c*. When an exhaust gas flows into the turbocharger 31, the turbine 31*a* is rotated by the flow of the exhaust gas, and the compressor 31*b* is rotated as the turbine 31*a* is rotated. Air (intake air) pressurized by the rotation of the compressor 31*b* is fed into the intake pipe 20, and supplied to the respective intake ports 18.

An intercooler 32 is provided in the intake pipe 20 downstream of the compressor 31*b*, and a throttle valve 33 is provided downstream of the intercooler 32. The upstream side and the downstream side of the exhaust pipe 26, between which the turbocharger 31 is interposed, are connected together by an exhaust bypass passage 34. That is, the exhaust bypass passage 34 is a passage for bypassing the turbine 31*a* of the turbocharger 31. A wastegate valve 35 is provided in the exhaust bypass passage 34. The wastegate valve 35 is equipped with a valve body 35*a* and an electric actuator (electric motor) 35*b* for driving the valve body 35*a*, and is adapted to adjust the amount of the exhaust gas flowing through the exhaust bypass passage 34 in response to the valve opening position of the valve body 35*a*. That is, the wastegate valve 35 is configured to be capable of controlling the boost pressure of the turbocharger 31 by adjustment of its opening position.

A three-way catalyst 36, which is an exhaust gas purification catalyst, is interposed in the exhaust pipe 26 downstream of the turbocharger 31. An $O_2$ sensor 37 for detecting the $O_2$ concentration of the exhaust gas after passage through the catalyst is provided on the outlet side of the three-way catalyst 36. A linear air-fuel ratio sensor (LAFS) as an air-fuel ratio detection device for detecting the air-fuel ratio of the exhaust gas (exhaust air-fuel ratio) before passage through the catalyst is provided on the inlet side of the three-way catalyst 36. Detection of the exhaust air-fuel ratio is not limited to the one by the linear air-fuel ratio sensor (LAFS). For example, an $O_2$ sensor may be provided instead of the linear air-fuel ratio sensor, and the exhaust air-fuel ratio may be estimated based on the results of detection by the $O_2$ sensor.

The engine 10 also has an electronic control unit (ECU) 40, and the ECU 40 includes an input-output device, a storage device for storing a control program, a control map, etc., a central processing unit, a timer, and counters. Based on information from various sensors, the ECU 40 exercises the integrated control of the engine 10. A fuel injection control apparatus of an engine according to the present embodiment is constituted by the above ECU 40, and controls, as appropriate, the injection volumes of the first fuel injection valve 28 and the second fuel injection valve 29, as will be described below.

Learning control by the fuel injection control apparatus of an engine according to the present embodiment will be described hereinbelow.

Figure 2:
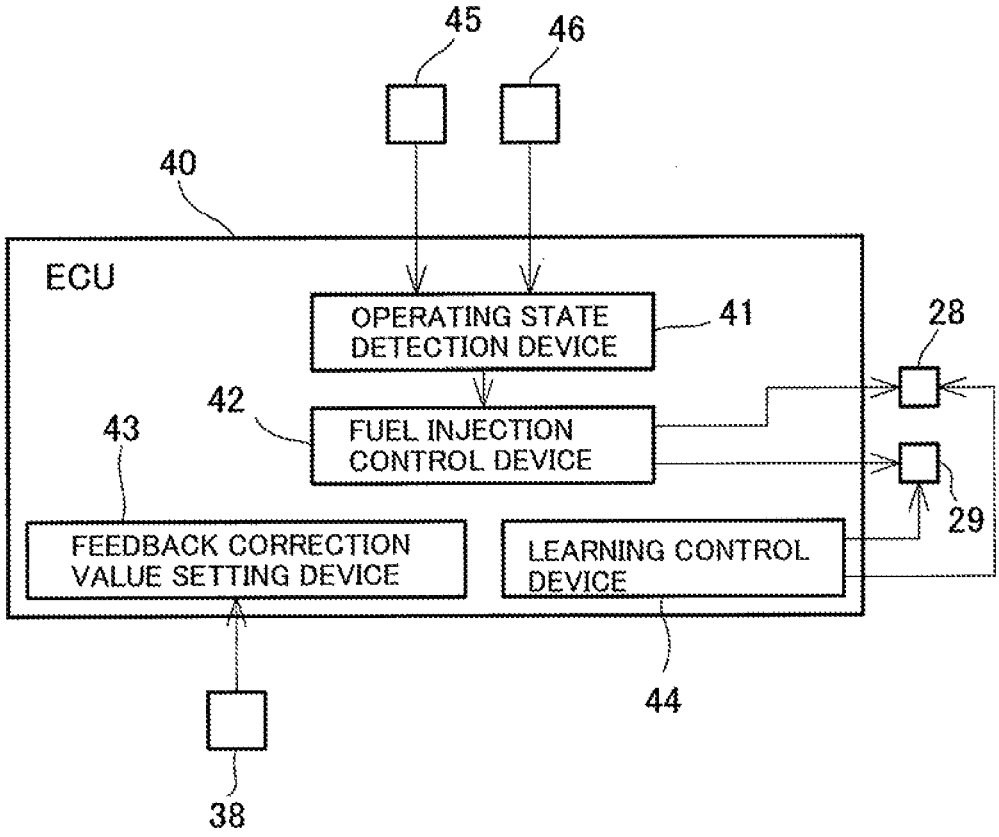
FIG. 2 is a block diagram showing a fuel injection control apparatus according to the embodiment of the present invention.

As shown in FIG. 2, the ECU 40 includes an operating state detection device 41, a fuel injection control device 42, a feedback correction value setting device 43, and a learning control device 44. The operating state detection device 41 detects the operating state of the engine 10, for example, based on information from the various sensors such as a throttle position sensor 45 and a crank angle sensor 46.

Figure 3:
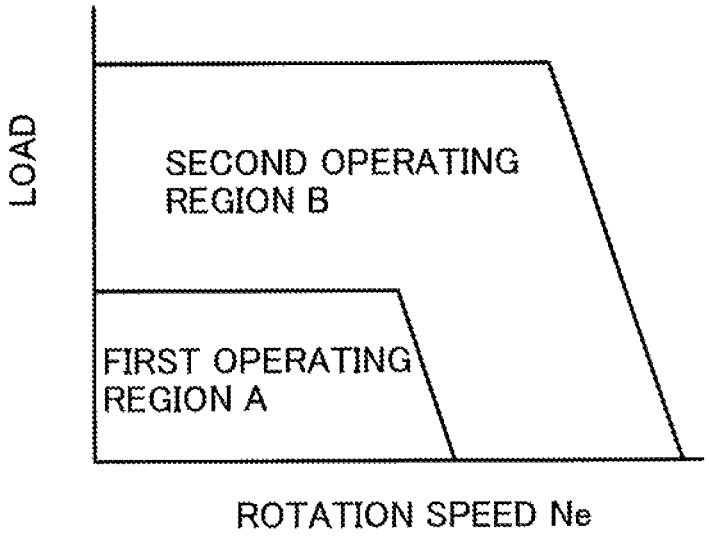
FIG. 3 is a view showing an example of a map for specifying the operating region of the engine.

The fuel injection control device 42 controls, as appropriate, the fuel injection volumes of the first fuel injection valve 28 and the second fuel injection valve 29 so that the exhaust air-fuel ratio detected by the linear air-fuel ratio sensor (LAFS) 38 as the air-fuel ratio detection device will become a target air-fuel ratio set in accordance with the operating state of the engine 10. In the present embodiment, the fuel injection control device 42 controls, as appropriate, the volumes of fuel injected from the first fuel injection valve 28 and the second fuel injection valve 29, and also alters, as appropriate, the injection ratio of fuel injected from the first fuel injection valve 28 and the second fuel injection valve 29. Concretely, the fuel injection control device 42 refers to an operating region map as shown in FIG. 3 and, depending on which of the operating regions the current operating state of the engine 10 is in, determines the relative injection ratio between the first fuel injection valve 28 and the second fuel injection valve 29, and the injection volume (e.g., pulse width) of each fuel injection valve.

In the present embodiment, the fuel injection control device 42 exercises, depending on the operating state of the engine 10, control for injecting fuel only from the first fuel injection valve 28 (hereinafter referred to as "MPI injection control"), and control for injecting fuel from each of the first fuel injection valve 28 and the second fuel injection valve 29 at a predetermined injection ratio (hereinafter referred to as "MPI+DI injection control"). In the map shown in FIG. 3, for example, the operating region of the engine 10 is set based on the rotation speed Ne of the engine 10 and the load on the engine 10, and includes two regions, i.e., a first operating region A which is the operating region on a low rotation speed, low load side and a second operating region B which is the operating region on a high rotation speed, high load side.

If the operating state of the engine 10 is in the first operating region A, the fuel injection control device 42 executes "MPI injection control". That is, the first operating region A is set such that injection only from the first fuel injection valve 28 is performed, for the following reasons: In this low rotation speed, low load region, the amount of intake air is small, and the flow velocity of air is low. Thus, fuel injected from the second fuel injection valve 29 is insufficiently mixed within the combustion chamber 17, and a large amount of unburned fuel is contained in an exhaust gas after combustion. As a result, adverse influence is exerted on the environment. Moreover, fuel directed injected into the combustion chamber 17 easily deposits, as fuel droplets, on the top face of the piston or on the cylinder wall, thus presenting the cause of dilution or carbon formation.

If the operating state of the engine 10 is in the second operating region B, on the other hand, the fuel injection control device 42 executes "MPI+DI injection control". That is, the second operating region B is set such that fuel is injected from both of the first fuel injection valve 28 and the second fuel injection valve 29. This is because as the injection volume from the second fuel injection valve 29 increases, the temperature within the combustion chamber 17 lowers owing to the heat of vaporization of the fuel injected from the second fuel injection valve 29, thus resulting in a better combustion efficiency.

Furthermore, the fuel injection control device 42 corrects, as appropriate, the thus set injection volumes of the first fuel injection valve 28 and the second fuel injection valve 29 based on a feedback correction value, which is set by the feedback correction value setting device 43 to be described later, and a learning value which is set by the learning control device 44 to be described later. That is, in the present embodiment, the fuel injection control device 42 sets, as appropriate, the injection volumes (pulse widths) of the first fuel injection valve 28 and the second fuel injection valve 29 and various correction values (deposition correction, purge concentration correction), based on "amount of intake air", "injection characteristics of each fuel injection valve", and "target air-fuel ratio" as well as the above "feedback correction value" and "learning value".

The "injection characteristic of the fuel injection valve" corresponds to an injector gain (volume of fuel, cc/s, which can be injected when the fuel injection valve is driven for a unit time), and is used, for example, in calculating the pulse width. The injector gain is a measured value obtained by measurement before loading on the engine.

The feedback correction value setting device 43 sets a feedback correction value (feedback correction factor) by feedback control based on the exhaust air-fuel ratio detected by the linear air-fuel ratio sensor (LAFS) 38 (this ratio will hereinafter be referred to as "measured air-fuel ratio"). That is, the feedback correction value setting device 43 compares the measured air-fuel ratio with the target air-fuel ratio, and sets, as appropriate, a feedback correction value so that the measured air-fuel ratio approaches the target air-fuel ratio (e.g., stoichiometric air-fuel ratio). The feedback correction value is set, for example, such that its initial value is "1.0". The feedback correction value setting device 43 either sets the feedback correction value at a value smaller than "1.0" if the measured air-fuel ratio is on the rich side, or sets the feedback correction value at a value larger than "1.0" if the measured air-fuel ratio is on the lean side. At this time, the feedback correction value setting device 43 successively sets (updates) the feedback correction value so that a preset change rate will be obtained.

Figure 4:
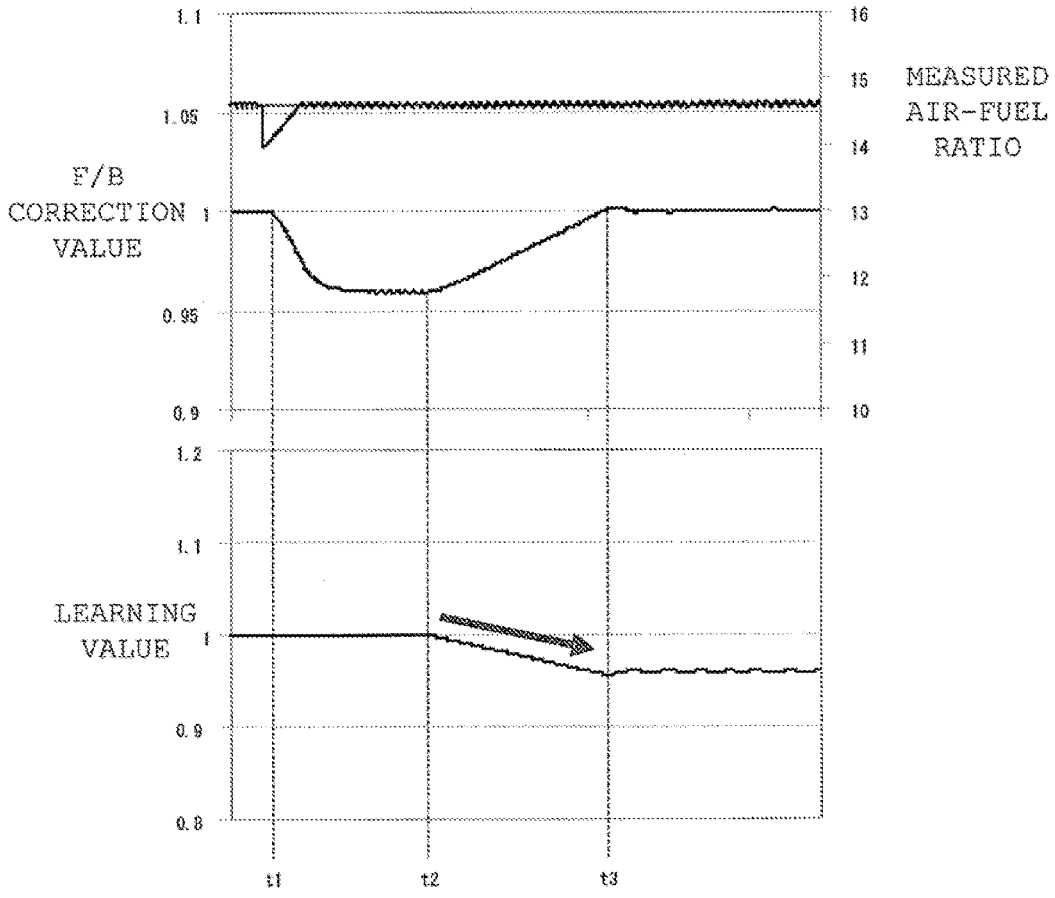
FIG. 4 is a time chart illustrating an example of first learning control.

For example, when the measured air-fuel ratio changes from the stoichiometric side to the rich side at time t1, as shown in FIG. 4, the feedback correction value is set at a value smaller than "1.0" accordingly. That is, until the measured air-fuel ratio returns to the stoichiometric one, the feedback correction value is gradually set at (updated to) a smaller value at a nearly constant change rate (inclination). In this example, the feedback correction value is gradually decreased to reach "0.96".

The learning control device 44 executes, with a predetermined timing, learning control for learning the amount of deviation in the injection volume of the first fuel injection value 28 and the second fuel injection value 29 based on the feedback correction value set by the feedback correction value setting device 43, and sets the results as the learning value (makes an update). If a state where the feedback correction value is changed from the initial value ("1.0") continues for a predetermined time or longer, for example, the learning control device 44 performs learning control. The learning control is terminated at a time when the feedback correction value returns to the initial value. Concretely, the learning control device 44 gradually decreases the learning value, in learning control, when the feedback correction value is smaller than the initial value, but gradually increases the learning value when the feedback correction value is larger than the initial value. The change rate (the amount of change per unit time=inclination) of the learning value on this occasion is preset to such an extent that no fluctuations in the air-fuel ratio substantially occur. When the feedback correction value gradually changes in accordance with the change in the learning value and reaches the initial value, the learning control device 44 terminates the learning control, and sets the value at this point in time as the learning value (makes an update).

In the present embodiment, with the operating state of the engine 10 being in the first operating region A and "MPI injection control" being exercised, the learning control device 44 first executes learning control for learning the amount of deviation in the injection volume of the first fuel injection valve (intake passage injection valve) 28 (i.e., first learning control) to set a learning value (first learning value).

As shown in FIG. 4, the learning control device 44 first starts the first learning control at time t2. Since the feedback control value at this point in time is "0.96", the learning control device 44 gradually decreases the learning value. When the feedback correction value increases with decreases in the learning value to reach the initial value, the learning control device 44 terminates the first learning control (time t3), and sets the value at this time as a learning value (first learning value) (makes an update). In this example, the learning value at the time t3 (first learning value) is set at "0.96". It is to be noted that the change rate of the learning value in the first learning control is preset to such an extent that the measured air-fuel ratio does not substantially fluctuate with changes in the feedback correction value associated with changes in the learning value.

When the first learning value is set by the learning control device 44 in this manner, the fuel injection control device 42 sets, as appropriate, the injection volume of the first fuel injection valve 28 based on the first learning value.

Then, with the operating state of the engine 10 being in the second operating region B and "MPI+DI injection control" being exercised, the learning control device 44 executes learning control for learning the amount of deviation in the injection volume of the second fuel injection valve (cylinder injection valve) 29 (i.e., second learning control) to set a learning value (second learning value) (i.e., update the learning value to determine the second learning value).

Figure 5:
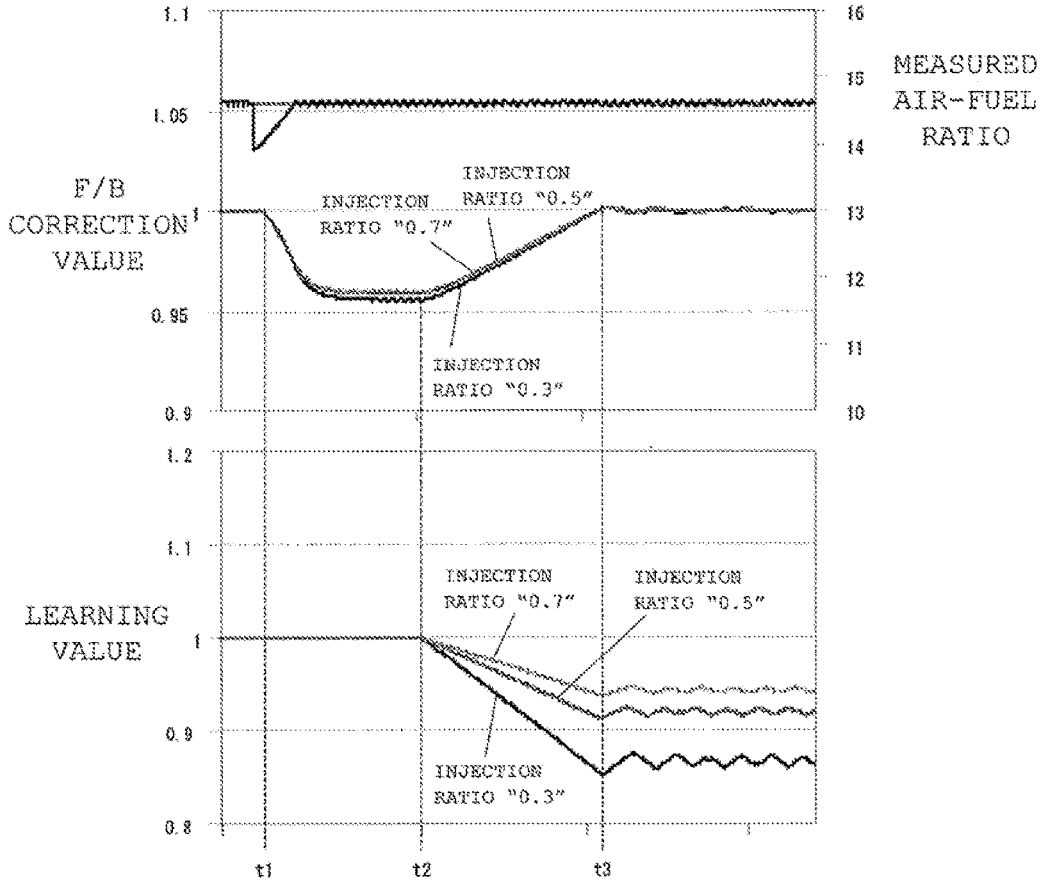
FIG. 5 is a time chart showing changes in respective parameters in fuel injection control according to the embodiment of the present invention.

The procedure for the second learning control is basically the same as that for the first learning control. With the second learning control, however, the learning control device 44 alters the change rate (inclination) of the learning value in accordance with the injection ratio between the first fuel injection valve 28 and the second fuel injection valve 29. Concretely, the lower the injection ratio of the second fuel injection valve 29 to the first fuel injection valve 28, the greater change rate of the learning value the learning control device 44 provides. For example, when the injection ratio of the second fuel injection valve 29 to the first fuel injection valve 28 is "0.3", "0.5" or "0.7", as shown in FIG. 5, the change rate of the learning value at the injection ratio of "0.3" is rendered the largest, while the change rate of the learning value at the injection ratio of "0.7" is rendered the smallest. By so altering the change rate of the learning value, as appropriate, the change rate of the feedback correction value associated with the changes in the learning value (i.e., the change rate over t2 through t3) is rendered a preset, nearly constant change rate, regardless of the injection ratio (see FIG. 5).

When the injection ratio of the second fuel injection valve 29 to the first fuel injection valve 28 is "0.5", for example, influence on the air-fuel ratio associated with the change in the learning value is nearly a half of that when the injection ratio is "1.0". That is, the change rate of the feedback correction value is nearly a half of that when the injection ratio is "1.0". Thus, when the injection ratio of the second fuel injection valve 29 to the first fuel injection valve 28 is "0.5", the change rate of the feedback correction value agrees practically with that when the injection ratio is "1.0", even if the change rate of the learning value is set to be nearly twice that when the injection ratio is "1.0". That is, even if the change rate of the learning value is doubled, the measured air-fuel ratio does not substantially change.

Similarly, when the injection ratio of the second fuel injection valve 29 to the first fuel injection valve 28 is "0.3", for example, influence on the air-fuel ratio associated with the change in the learning value is nearly a third of that when the injection ratio is "1.0". That is, the change rate of the feedback correction value is nearly a third of that when the injection ratio is "1.0". Thus, when the injection ratio of the second fuel injection valve 29 to the first fuel injection valve 28 is "0.3", the change rate of the feedback correction value agrees practically with that when the injection ratio is "1.0", even if the change rate of the learning value is set to be nearly three times that when the injection ratio is "1.0". That is, even if the change rate of the learning value is tripled, the measured air-fuel ratio does not substantially change. As discussed here, when the injection ratio of the second fuel injection valve 29 to the first fuel injection valve 28 is "0.3", the change rate of the learning value can be set in accordance with the injection ratio, with the change rate of the learning value at the injection ratio of "1.0" being the upper limit, to minimize influence on the air-fuel ratio associated with the change in the learning value.

Therefore, by altering, as appropriate, the change rate (inclination) of the learning value in accordance with the injection ratio between the first fuel injection valve 28 and the second fuel injection valve 29 in the second learning control as described above, it is possible to inhibit the duration of the second learning control from lengthening, while suppressing changes in the measured air-fuel ratio. Even without adopting the operating region where the injection ratio of the second fuel injection valve 29 to the first fuel injection valve 28 is "1.0", moreover, learning of the fuel injection volume of the second fuel injection valve 29 can be performed in a short time by the second learning control.

Even if the operating state fails to reach the operating region where the injection ratio of the second fuel injection valve 29 to the first fuel injection valve 28 is "1.0" (i.e., direct injection region involving only DI injection), or even if the direct injection region as shown in FIG. 3 is not provided, learning of the injection volumes of the first fuel injection valve 28 and the second fuel injection valve 29 can be performed in a short time and with accuracy. If the learning can be terminated early, the injection volumes of the first fuel injection valve 28 and the second fuel injection valve 29 can be optimized to suppress, at an early stage, the deterioration of the exhaust gas due to deviation in the air-fuel ratio, thereby reducing, for example, the amount of a precious metal supported on a catalyst for purifying the exhaust gas.

Figure 6:
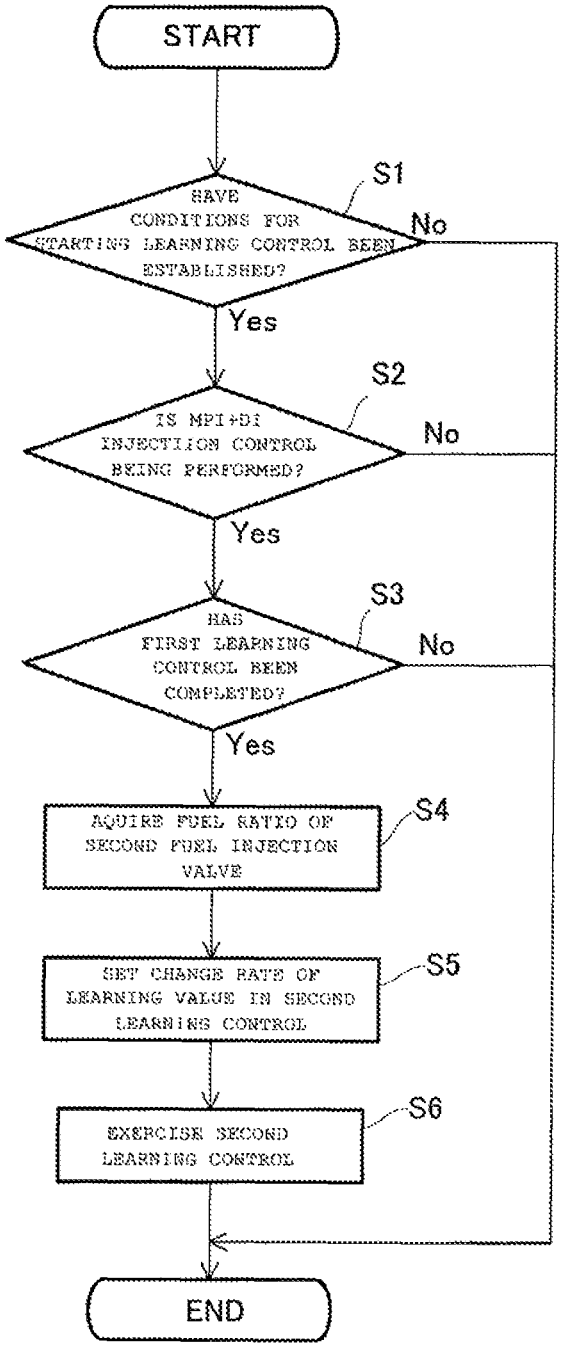
FIG. 6 is a flowchart showing an example of the fuel injection control according to the embodiment of the present invention.

Such second learning control is performed, for example, by the procedure of a flowchart shown in FIG. 6. First of all, in Step S1, it is determined whether the conditions for starting learning control have been established. The starting conditions may be set, as appropriate. An example of them is that a state where the feedback correction value has been changed from the initial value ("1.0") continues for a predetermined time or longer, as stated earlier. If such starting conditions for learning control hold (Step S1: Yes), then it is determined in Step S2 whether "MPI+DI injection control" is being executed.

If "MPI+DI injection control" is under way here (Step S2: Yes), it is determined in Step S3 further that first learning control has been completed. That is, it is determined whether the amount of deviation in the fuel injection volume of the first fuel injection valve 28 has been corrected. If the first learning control has been completed (Step S3: Yes), the program proceeds to Step S4 to acquire the injection ratio of the second fuel injection valve 29 to the first fuel injection valve 28. Then, in Step S5, the change rate of a learning value in second learning control is set in accordance with the injection ratio of the second fuel injection valve 29 to the first fuel injection valve 28. Then, the second learning control is performed (Step S6). If the conditions for starting the learning control have not been established (Step S1: No), or if "MPI+DI injection control" has not been executed (Step S2: No), or if the first learning control has not been completed (Step S3: No), a series of processings is terminated without execution of the second learning control.

The present invention has been described above in regard to one embodiment thereof, but it is to be understood that the present invention is in no way limited to this embodiment. The present invention can be changed or modified, as appropriate, without departing from its spirit and scope.

In the above embodiment, for example, the explanations have been offered for the learning control when the feedback correction value has become less than 1.0. However, learning control is also exercised when the feedback correction value has become larger than 1.0. It goes without saying that the present invention can be applied in such a case as well. With learning control in a state where the feedback correction value is greater than 1.0, the learning value is to be increased gradually until the feedback correction value returns to 1.0.

EXPLANATIONS OF LETTERS OR NUMERALS

10 Engine
11 Engine body
12 Cylinder head
13 Cylinder block
14 Piston
15 Connecting rod
16 Crank shaft
17 Combustion chamber
18 Intake port
19 Intake manifold
20 Intake pipe
22 Intake temperature sensor
23 Intake valve
24 Exhaust port
25 Exhaust manifold
26 Exhaust pipe
27 Exhaust valve
28 First fuel injection valve
29 Second fuel injection valve
30 Ignition plug
31 Turbocharger
31*a* Turbine
31*b* Compressor
31*c* Turbine shaft
32 Intercooler
33 Throttle valve
34 Exhaust bypass passage
35 Wastegate valve
35*a* Valve body
36 Three-way catalyst
37 $O_2$ sensor
38 Linear air-fuel ratio sensor (exhaust air-fuel ratio detection device)
41 Operating state detection device
42 Fuel injection control device
43 Feedback correction value setting device
44 Learning control device
45 Throttle position sensor
46 Crank angle sensor

The invention claimed is:

1. A fuel injection control apparatus of an engine, comprising:

a first fuel injection valve for injecting fuel into an intake passage of the engine;

a second fuel injection valve for injecting fuel into a combustion chamber of the engine;

an air-fuel ratio detection device for detecting an exhaust air-fuel ratio of the engine; and a processor and a storage device storing instructions that cause the processor to:

set, as a feedback correction value setting device, a feedback correction value by feedback control based on detection results of the air-fuel ratio detection device;

exercise, as a learning control device, learning control for learning deviation amounts of injection volumes of the first fuel injection valve and the second fuel injection valve based on the feedback correction value to set a learning value, exercise the learning control over one of the first fuel injection valve and the second fuel injection valve in an operating region of the engine where the fuel is injected from each of the first fuel injection valve and the second fuel injection valve, and alter a change rate of the learning value by the learning control in accordance with an injection ratio between the first fuel injection valve and the second fuel injection valve; and control, as a fuel injection control device, fuel injection volumes injected from the first fuel injection valve and the second fuel injection valve in accordance with an operating state of the engine, and controls the fuel injection volumes of the first fuel injection valve and the second fuel injection valve, based on the feedback correction value and the learning value, such that the exhaust air-fuel ratio becomes a target air-fuel ratio, wherein the learning control device renders the change rate of the learning value greater as the injection ratio of the one fuel injection valve to the other fuel injection valve becomes lower, such that a change rate of the feedback correction value associated with changes in the learning value assumes a constant value regardless of injection ratios.

2. The fuel injection control apparatus of an engine according to claim 1, wherein before exercising the learning control over the one fuel injection valve, the learning control device effects the learning control over the other fuel injection valve in an operating region where there is no fuel injection from the one fuel injection valve.

3. The fuel injection control apparatus of an engine according to claim 1, wherein before exercising the learning control over the one fuel injection valve, the learning control device effects the learning control over the other fuel injection valve in an operating region where there is no fuel injection from the one fuel injection valve.

* * * * *